US011502391B2

(12) United States Patent
Yong et al.

(10) Patent No.: US 11,502,391 B2
(45) Date of Patent: Nov. 15, 2022

(54) ELECTRONIC DEVICES HAVING DIFFERENTIALLY-LOADED MILLIMETER WAVE ANTENNAS

(71) Applicant: Apple Inc., Cupertino, CA (US)

(72) Inventors: Siwen Yong, Mountain View, CA (US); Jiangfeng Wu, San Jose, CA (US); Yi Jiang, Cupertino, CA (US); Simon G. Begashaw, Santa Clara, CA (US); Harish Rajagopalan, San Jose, CA (US); Hee-Joung Joun, San Jose, CA (US); Thomas W. Yang, Sunnyvale, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 18 days.

(21) Appl. No.: 17/031,618

(22) Filed: Sep. 24, 2020

(65) Prior Publication Data

US 2022/0094036 A1 Mar. 24, 2022

(51) Int. Cl.
*H01Q 1/22* (2006.01)
*H01Q 3/26* (2006.01)
*H01Q 1/38* (2006.01)

(52) U.S. Cl.
CPC ..... *H01Q 1/2283* (2013.01); *H01Q 1/38* (2013.01); *H01Q 3/2617* (2013.01)

(58) Field of Classification Search
CPC ..... H01Q 1/2283; H01Q 1/38; H01Q 3/2617
See application file for complete search history.

(56) References Cited

U.S. PATENT DOCUMENTS

| | | | |
|---|---|---|---|
| 9,692,102 | B2 | 6/2017 | Herbsommer et al. |
| 10,109,604 | B2 | 10/2018 | Topak et al. |
| 10,333,047 | B2 | 6/2019 | Gilbert et al. |
| 10,594,028 | B2 | 3/2020 | Yong et al. |
| 10,629,553 | B2 | 4/2020 | Soliman et al. |
| 10,673,130 | B2 | 6/2020 | de Rochemont |
| 10,741,906 | B2 | 8/2020 | Gomez Angulo et al. |
| 10,741,932 | B2 | 8/2020 | Thai et al. |
| 2019/0252771 | A1 * | 8/2019 | Yong ..... H01Q 21/22 |

(Continued)

FOREIGN PATENT DOCUMENTS

JP 2004505584 A * 2/2004 ..... H01Q 23/00

*Primary Examiner* — Hoang V Nguyen
(74) *Attorney, Agent, or Firm* — Treyz Law Group, P.C.; Michael H. Lyons

(57) ABSTRACT

An electronic device may have an antenna that conveys radio-frequency signals at frequencies greater than 10 GHz. The antenna may be embedded in a substrate. The substrate may have routing layers, first antenna layers on the routing layers, second antenna layers on the first antenna layers, and a third antenna layers on the second antenna layers. The antenna may include first traces on the first antenna layers, second traces on the second antenna layers, and third traces on the third antenna layers. The first antenna layers may have a first bulk dielectric permittivity. The second layers may have a second bulk dielectric permittivity. The third layers may have a third bulk dielectric permittivity. At least one of the first, second, and third bulk dielectric permittivities may be different from the others. This may differentially load the antenna across the antenna layers, thereby broadening the bandwidth of the antenna.

20 Claims, 9 Drawing Sheets

(56) References Cited

U.S. PATENT DOCUMENTS

| | | | | |
|---|---|---|---|---|
| 2020/0067183 | A1* | 2/2020 | Chang | H01Q 21/24 |
| 2020/0091608 | A1 | 3/2020 | Alpman et al. | |
| 2020/0106192 | A1 | 4/2020 | Avser et al. | |
| 2020/0161744 | A1 | 5/2020 | Baks et al. | |

* cited by examiner

ELECTRONIC DEVICES HAVING DIFFERENTIALLY-LOADED MILLIMETER WAVE ANTENNAS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies can support high throughput but may raise significant challenges. For example, if care is not taken, the antennas might exhibit insufficient bandwidth to cover the entirety of a frequency band of interest.

It would therefore be desirable to be able to provide electronic devices with improved wireless communications circuitry such as communications circuitry that supports millimeter and centimeter wave communications.

SUMMARY

An electronic device may be provided with wireless circuitry. The wireless circuitry may include a phased antenna array. The phased antenna array may convey radio-frequency signals in a signal beam at a frequency greater than 10 GHz.

An antenna in the phased antenna array may be formed on a dielectric substrate. The dielectric substrate may have routing layers, a first set of antenna layers on the routing layers, a second set of antenna layers on the first set of antenna layers, and a third set of antenna layers on the second set of antenna layers. The antenna may include a first layer of conductive traces on an uppermost layer of the first set of antenna layers. A second layer of conductive traces may be patterned on an uppermost layer of the second set of antenna layers. A third layer of conductive traces may be patterned on an uppermost layer of the third set of antenna layers. Ground traces may be patterned on an uppermost layer of the routing layers. Signal traces on the routing layers may be coupled to positive antenna feed terminal(s) on the first and optionally the second layers of conductive traces.

In order to broaden the bandwidth of the antenna, the dielectric substrate may differentially load the antenna across the first, second, and third sets of antenna layers. For example, the first set of antenna layers may have a first bulk dielectric permittivity. The second set of antenna layers may have a second bulk dielectric permittivity. The third set of antenna layers may have a third bulk dielectric permittivity. At least one of the first, second, and third bulk dielectric permittivities may be different from the others of the first, second, and third bulk dielectric permittivities. The routing layers may have a bulk dielectric permittivity that is less than or equal to the lowest of the first, second, and third bulk dielectric permittivities. The bulk dielectric permittivities may be created using layers having a relatively high dielectric permittivity and layers having a relatively low dielectric permittivity. Additional layers having additional dielectric permittivities may also be used if desired.

DETAILED DESCRIPTION

Figure 1:
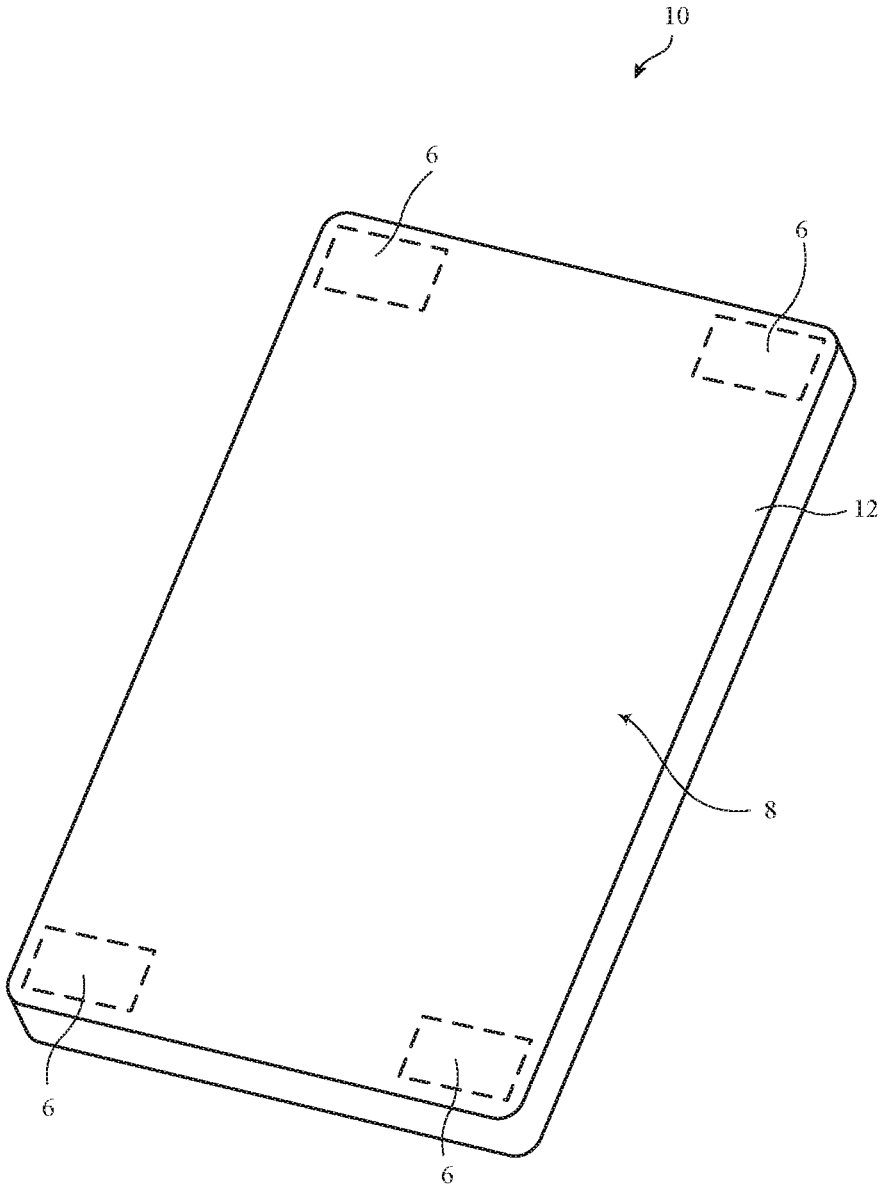
FIG. 1 is a front perspective view of an illustrative electronic device with wireless circuitry in accordance with some embodiments.

An electronic device such as electronic device 10 of FIG. 1 may contain wireless circuitry. The wireless circuitry may include one or more antennas. The antennas may include phased antenna arrays that are used for performing wireless communications and/or spatial ranging operations using millimeter and centimeter wave signals. Millimeter wave signals, which are sometimes referred to as extremely high frequency (EHF) signals, propagate at frequencies above about 30 GHz (e.g., at 60 GHz or other frequencies between about 30 GHz and 300 GHz). Centimeter wave signals propagate at frequencies between about 10 GHz and 30 GHz. If desired, device 10 may also contain antennas for handling satellite navigation system signals, cellular telephone signals, local wireless area network signals, near-field communications, light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station, a desktop computer, a portable speaker, a keyboard, a gaming controller, a gaming system, a computer mouse, a mousepad, a trackpad or touchpad, equipment that implements the functionality of two or more of these devices, or other electronic equipment. In the illustrative configuration of FIG. 1, device 10 is a portable device such as a cellular telephone, media player, tablet computer, portable speaker, or other portable computing device. Other configurations may be used for device 10 if desired. The example of FIG. 1 is merely illustrative.

As shown in FIG. 1, device 10 may include a display such as display 8. Display 8 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 8 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch sensor electrodes may be formed from an array of indium tin oxide pads or other transparent conductive structures.

Display 8 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 8 may be protected using a display cover layer such as a layer of transparent glass, clear plastic, sapphire, or other transparent dielectrics. Openings may be formed in the display cover layer. For example, openings may be formed in the display cover layer to accommodate one or more buttons, sensor circuitry such as a fingerprint sensor or light sensor, ports such as a speaker port or microphone port, etc. Openings may be formed in housing 12 to form communications ports (e.g., an audio jack port, a digital data port, charging port, etc.). Openings in housing 12 may also be formed for audio components such as a speaker and/or a microphone.

Antennas may be mounted in housing 12. If desired, some of the antennas (e.g., antenna arrays that implement beam steering, etc.) may be mounted under an inactive border region of display 8 (see, e.g., illustrative antenna locations 6 of FIG. 1). Display 8 may contain an active area with an array of pixels (e.g., a central rectangular portion). Inactive areas of display 8 are free of pixels and may form borders for the active area. If desired, antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 6 of FIG. 1 and/or in corner locations on the rear of housing 12), along the peripheral edges of housing 12, on the rear of housing 12, under the display cover glass or other dielectric display cover layer that is used in covering and protecting display 8 on the front of device 10, over a dielectric window on a rear face of housing 12 or the edge of housing 12, over a dielectric cover layer such as a dielectric rear housing wall that covers some or all of the rear face of device 10, or elsewhere in device 10.

Figure 2:
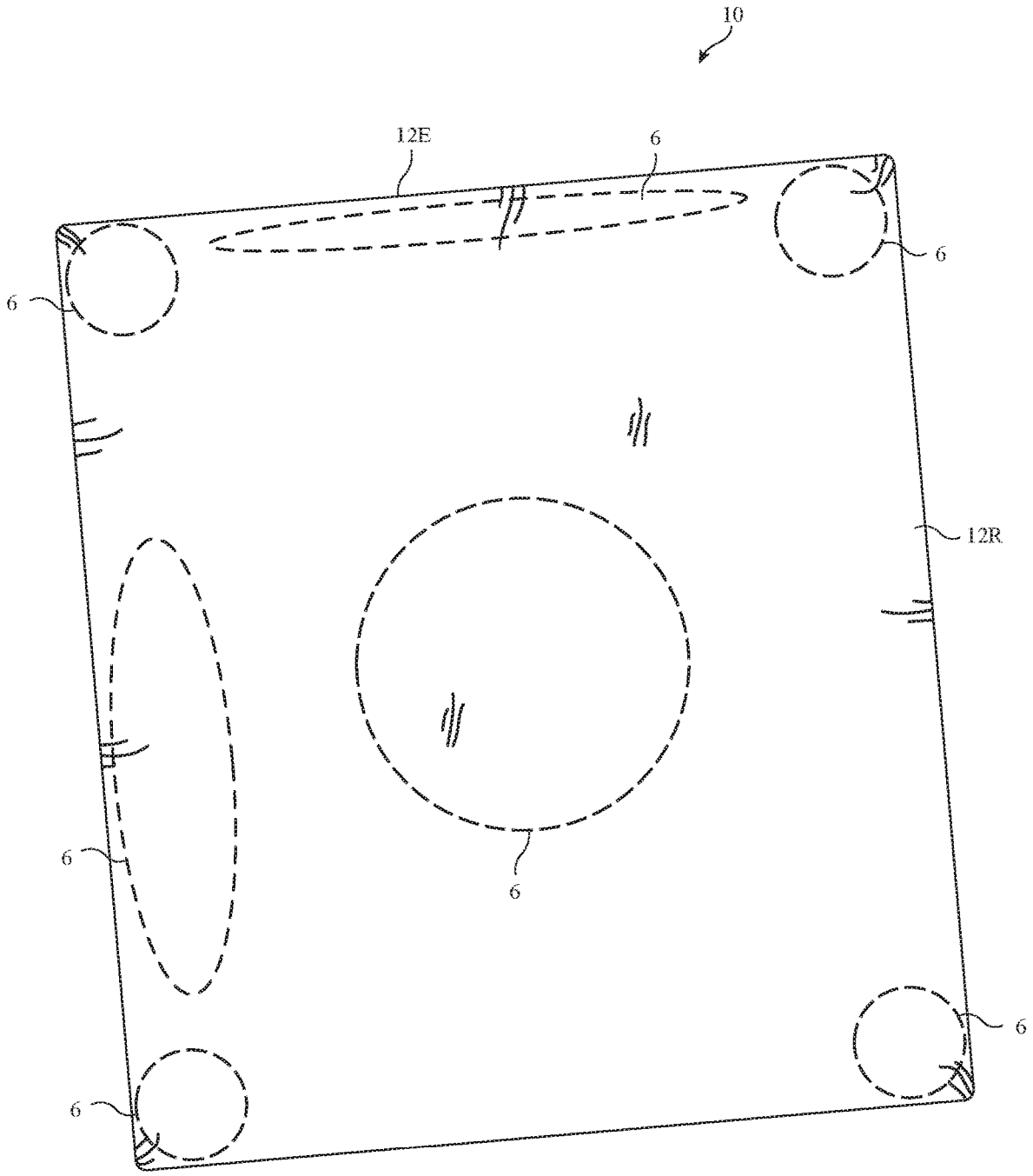
FIG. 2 is a rear perspective view of an illustrative electronic device with wireless circuitry in accordance with some embodiments.

FIG. 2 is a rear perspective view of electronic device 10 showing illustrative locations 6 on the rear and sides of housing 12 in which antennas (e.g., single antennas and/or phased antenna arrays) may be mounted in device 10. The antennas may be mounted at the corners of device 10, along the edges of housing 12 such as edges formed by sidewalls 12E, on upper and lower portions of rear housing wall 12R, in the center of rear housing wall 12R (e.g., under a dielectric window structure or other antenna window in the center of rear housing wall 12R), at the corners of rear housing wall 12R (e.g., on the upper left corner, upper right corner, lower left corner, and lower right corner of the rear of housing 12 and device 10), etc.

In configurations in which housing 12 is formed entirely or nearly entirely from a dielectric (e.g., plastic, glass, sapphire, ceramic, fabric, etc.), the antennas may transmit and receive antenna signals through any suitable portion of the dielectric. In configurations in which housing 12 is formed from a conductive material such as metal, regions of the housing such as slots or other openings in the metal may be filled with plastic or other dielectrics. The antennas may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external wireless equipment from the antennas mounted within the interior of device 10 and may allow internal antennas to receive antenna signals from external wireless equipment. In another suitable arrangement, the antennas may be mounted on the exterior of conductive portions of housing 12.

FIGS. 1 and 2 are merely illustrative. In general, housing 12 may have any desired shape (e.g., a rectangular shape, a cylindrical shape, a spherical shape, combinations of these, etc.). Display 8 of FIG. 1 may be omitted if desired. Antennas may be located within housing 12, on housing 12, and/or external to housing 12.

Figure 3:
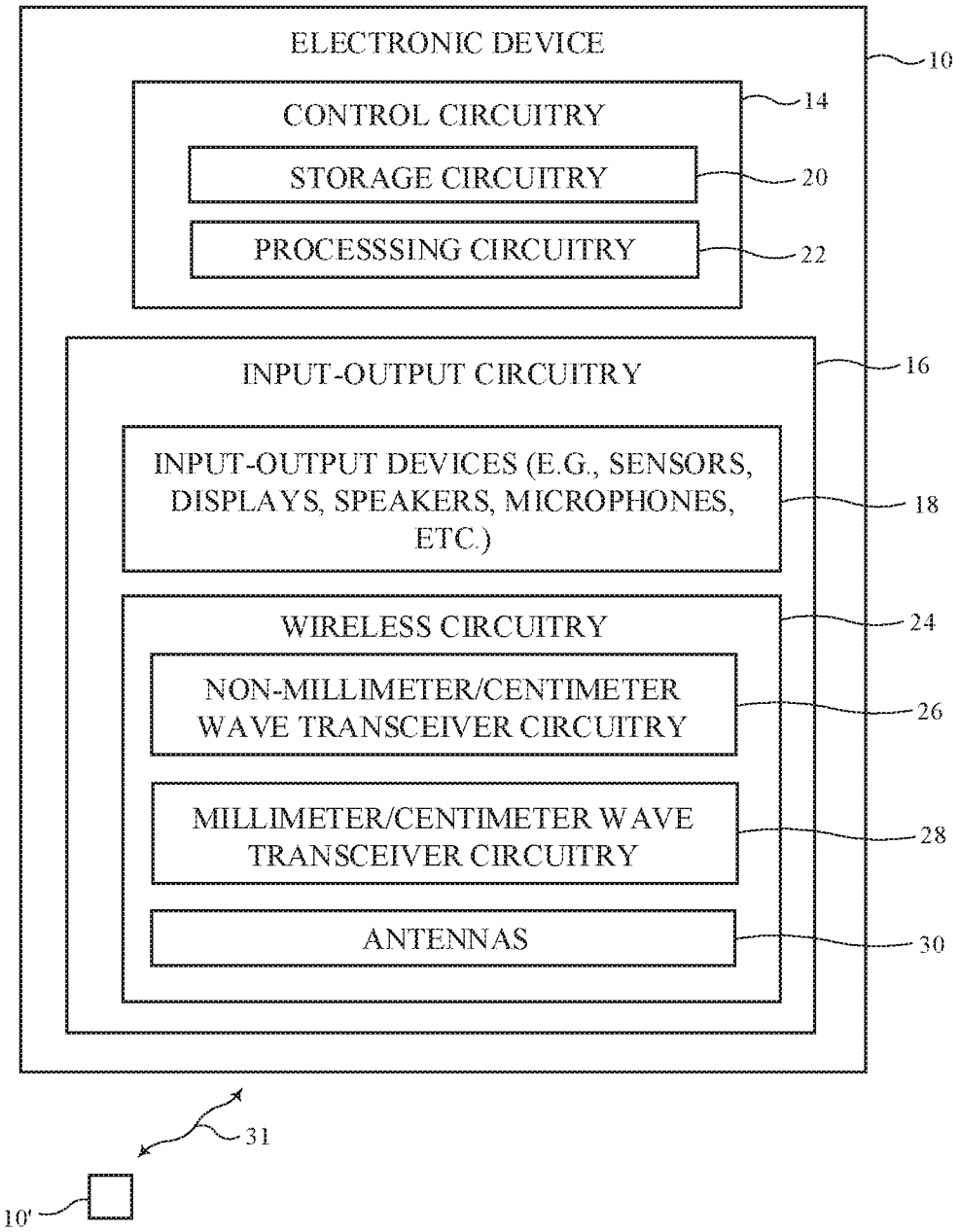
FIG. 3 is a schematic diagram of an illustrative electronic device with wireless circuitry in accordance with some embodiments.

A schematic diagram of illustrative components that may be used in device 10 is shown in FIG. 3. As shown in FIG. 3, device 10 may include control circuitry 14. Control circuitry 14 may include storage such as storage circuitry 20. Storage circuitry 20 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 14 may include processing circuitry such as processing circuitry 22. Processing circuitry 22 may be used to control the operation of device 10. Processing circuitry 22 may include on one or more microprocessors, microcontrollers, digital signal processors, host processors, baseband processor integrated circuits, application specific integrated circuits, central processing units (CPUs), etc. Control circuitry 14 may be configured to perform operations in device 10 using hardware (e.g., dedicated hardware or circuitry), firmware, and/or software. Software code for performing operations in device 10 may be stored on storage circuitry 20 (e.g., storage circuitry 20 may include non-transitory (tangible) computer readable storage media that stores the software code). The software code may sometimes be referred to as program instructions, software, data, instructions, or code. Software code stored on storage circuitry 20 may be executed by processing circuitry 22.

Control circuitry 14 may be used to run software on device 10 such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols. IEEE 802.1 lad protocols, cellular telephone protocols. MIMO protocols, antenna diversity protocols, satellite navigation system protocols, antenna-based spatial ranging protocols (e.g., radio detection and ranging (RADAR) protocols or other desired range detection protocols for signals conveyed at millimeter and centimeter wave frequencies), etc. Each communication protocol may be associated with a corresponding radio access technology (RAT) that specifies the physical connection methodology used in implementing the protocol.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless circuitry such as wireless circuitry 24 for wirelessly conveying radio-frequency signals. While control circuitry 14 is shown separately from wireless circuitry 24 in the example of FIG. 3 for the sake of clarity, wireless circuitry 24 may include processing circuitry that forms a part of processing circuitry 22 and/or storage circuitry that forms a part of storage circuitry 20 of control circuitry 14 (e.g., portions of control circuitry 14 may be implemented on wireless circuitry 24). As an example, control circuitry 14 may include baseband processor circuitry or other control components that form a part of wireless circuitry 24.

Wireless circuitry 24 may include millimeter and centimeter wave transceiver circuitry such as millimeter/centimeter wave transceiver circuitry 28. Millimeter/centimeter wave transceiver circuitry 28 may support communications at frequencies between about 10 GHz and 300 GHz. For example, millimeter/centimeter wave transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, millimeter/centimeter wave transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, millimeter/centimeter wave transceiver circuitry 28 may support IEEE 802.11ad communications at 60 GHz and/or $5^{th}$ generation mobile networks or $5^{th}$ generation wireless systems (5G) New Radio (NR) Frequency Range 2 (FR2) communications bands between about 24 GHz and 90 GHz. Millimeter/centimeter wave transceiver circuitry 28 may be formed from one or more integrated circuits (e.g., multiple integrated circuits mounted on a common printed circuit in a system-in-package device, one or more integrated circuits mounted on different substrates, etc.).

Millimeter/centimeter wave transceiver circuitry 28 (sometimes referred to herein simply as transceiver circuitry 28 or millimeter/centimeter wave circuitry 28) may perform spatial ranging operations using radio-frequency signals at millimeter and/or centimeter wave frequencies that are transmitted and received by millimeter/centimeter wave transceiver circuitry 28. The received signals may be a version of the transmitted signals that have been reflected off of external objects and back towards device 10. Control circuitry 14 may process the transmitted and received signals to detect or estimate a range between device 10 and one or more external objects in the surroundings of device 10 (e.g., objects external to device 10 such as the body of a user or other persons, other devices, animals, furniture, walls, or other objects or obstacles in the vicinity of device 10). If desired, control circuitry 14 may also process the transmitted and received signals to identify a two or three-dimensional spatial location of the external objects relative to device 10.

Spatial ranging operations performed by millimeter/centimeter wave transceiver circuitry 28 are unidirectional. If desired, millimeter/centimeter wave transceiver circuitry 28 may also perform bidirectional communications with external wireless equipment such as external wireless equipment 10' (e.g., over bi-directional millimeter/centimeter wave wireless communications link 31). External wireless equipment 10' may include other electronic devices such as electronic device 10, a wireless base station, wireless access point, a wireless accessory, or any other desired equipment that transmits and receives millimeter/centimeter wave signals. Bidirectional communications involve both the transmission of wireless data by millimeter/centimeter wave transceiver circuitry 28 and the reception of wireless data that has been transmitted by external wireless equipment 10'. The wireless data may, for example, include data that has been encoded into corresponding data packets such as wireless data associated with a telephone call, streaming media content, internet browsing, wireless data associated with software applications running on device 10, email messages, etc.

If desired, wireless circuitry 24 may include transceiver circuitry for handling communications at frequencies below 10 GHz such as non-millimeter/centimeter wave transceiver circuitry 26. For example, non-millimeter/centimeter wave transceiver circuitry 26 may handle wireless local area network (WLAN) communications bands such as the 2.4 GHz and 5 GHz Wi-Fi® (IEEE 802.11) bands, wireless personal area network (WPAN) communications bands such as the 2.4 GHz Bluetooth® communications band, cellular telephone communications bands such as a cellular low band (LB) (e.g., 600 to 960 MHz), a cellular low-midband (LMB) (e.g., 1400 to 1550 MHz), a cellular midband (MB) (e.g., from 1700 to 2200 MHz), a cellular high band (HB) (e.g., from 2300 to 2700 MHz), a cellular ultra-high band (UHB) (e.g., from 3300 to 5000 MHz, or other cellular communications bands between about 600 MHz and about 5000 MHz (e.g., 3G bands, 4G LTE bands, 5G New Radio Frequency Range 1 (FR1) bands below 10 GHz, etc.), a near-field communications (NFC) band (e.g., at 13.56 MHz), satellite navigations bands (e.g., an LI global positioning system (GPS) band at 1575 MHz, an L5 GPS band at 1176 MHz, a Global Navigation Satellite System (GLONASS) band, a BeiDou Navigation Satellite System (BDS) band, etc.), ultra-wideband (UWB) communications band(s) supported by the IEEE 802.15.4 protocol and/or other UWB communications protocols (e.g., a first UWB communications band at 6.5 GHz and/or a second UWB communications band at 8.0 GHz), and/or any other desired communications bands. The communications bands handled by the radio-frequency transceiver circuitry may sometimes be referred to herein as frequency bands or simply as "bands," and may span corresponding ranges of frequencies. Non-millimeter/centimeter wave transceiver circuitry 26 and millimeter/centimeter wave transceiver circuitry 28 may each include one or more integrated circuits, power amplifier circuitry, low-noise input amplifiers, passive radio-frequency components, switching circuitry, transmission line structures, and other circuitry for handling radio-frequency signals.

In general, the transceiver circuitry in wireless circuitry 24 may cover (handle) any desired frequency bands of interest. As shown in FIG. 3, wireless circuitry 24 may include antennas 30. The transceiver circuitry may convey radio-frequency signals using one or more antennas 30 (e.g., antennas 30 may convey the radio-frequency signals for the transceiver circuitry). The term "convey radio-frequency signals" as used herein means the transmission and/or reception of the radio-frequency signals (e.g., for performing unidirectional and/or bidirectional wireless communications with external wireless communications equipment). Antennas 30 may transmit the radio-frequency signals by radiating the radio-frequency signals into free space (or to freespace through intervening device structures such as a dielectric cover layer). Antennas 30 may additionally or alternatively receive the radio-frequency signals from free space (e.g., through intervening devices structures such as a dielectric cover layer). The transmission and reception of radio-frequency signals by antennas 30 each involve the excitation or resonance of antenna currents on an antenna resonating element in the antenna by the radio-frequency signals within the frequency band(s) of operation of the antenna.

In satellite navigation system links, cellular telephone links, and other long-range links, radio-frequency signals are typically used to convey data over thousands of feet or miles. In Wi-Fi® and Bluetooth® links at 2.4 and 5 GHz and other short-range wireless links, radio-frequency signals are typically used to convey data over tens or hundreds of feet. Millimeter/centimeter wave transceiver circuitry 28 may convey radio-frequency signals over short distances that travel over a line-of-sight path. To enhance signal reception for millimeter and centimeter wave communications, phased antenna arrays and beam forming (steering) techniques may be used (e.g., schemes in which antenna signal phase and/or magnitude for each antenna in an array are adjusted to perform beam steering). Antenna diversity schemes may also be used to ensure that the antennas that have become blocked or that are otherwise degraded due to the operating environment of device 10 can be switched out of use and higher-performing antennas used in their place.

Antennas 30 in wireless circuitry 24 may be formed using any suitable antenna types. For example, antennas 30 may include antennas with resonating elements that are formed from stacked patch antenna structures, loop antenna structures, patch antenna structures, inverted-F antenna structures, slot antenna structures, planar inverted-F antenna structures, monopole antenna structures, dipole antenna structures, helical antenna structures, Yagi (Yagi-Uda) antenna structures, hybrids of these designs, etc. If desired, one or more of antennas 30 may be cavity-backed antennas. Different types of antennas may be used for different bands and combinations of bands. For example, one type of antenna may be used in forming a non-millimeter/centimeter wave wireless link for non-millimeter/centimeter wave transceiver circuitry 26 and another type of antenna may be used in conveying radio-frequency signals at millimeter and/or centimeter wave frequencies for millimeter/centimeter wave transceiver circuitry 28. Antennas 30 that are used to convey radio-frequency signals at millimeter and centimeter wave frequencies may be arranged in one or more phased antenna arrays. In one suitable arrangement that is described herein as an example, the antennas 30 that are arranged in a corresponding phased antenna array may be stacked patch antennas having patch antenna resonating elements that overlap and are vertically stacked with respect to one or more parasitic patch elements.

Figure 4:
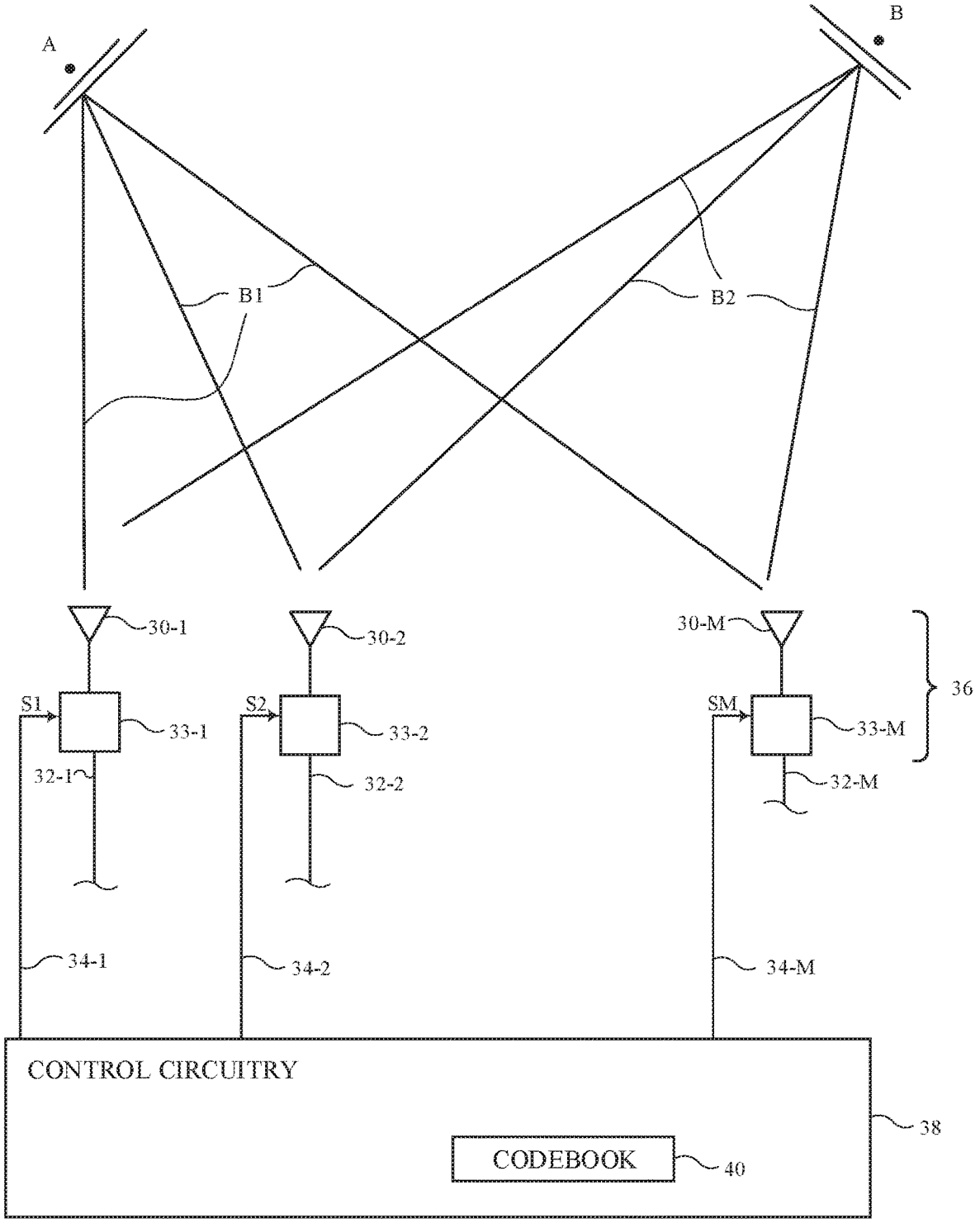
FIG. 4 is a diagram of an illustrative phased antenna array in accordance with some embodiments.

FIG. 4 is a diagram showing how antennas 30 for handling radio-frequency signals at millimeter and centimeter wave frequencies may be formed in a phased antenna array. As shown in FIG. 4, phased antenna array 36 (sometimes referred to herein as array 36, antenna array 36, or array 36 of antennas 30) may be coupled to radio-frequency transmission line paths 32. For example, a first antenna 30-1 in phased antenna array 36 may be coupled to a first radio-frequency transmission line path 32-1, a second antenna 30-2 in phased antenna array 36 may be coupled to a second radio-frequency transmission line path 32-2, an Mth antenna 30-M in phased antenna array 36 may be coupled to an Mth radio-frequency transmission line path 32-M, etc. While antennas 30 are described herein as forming a phased antenna array, the antennas 30 in phased antenna array 36 may sometimes also be referred to as collectively forming a single phased array antenna (e.g., where each antenna 30 in the phased array antenna forms an antenna element of the phased array antenna).

Radio-frequency transmission line paths 32 may each be coupled to millimeter/centimeter wave transceiver circuitry 28 of FIG. 3. Each radio-frequency transmission line path 32 may include one or more radio-frequency transmission lines, a positive signal conductor, and a ground signal conductor. The positive signal conductor may be coupled to a positive antenna feed terminal on an antenna resonating element of the corresponding antenna 30. The ground signal conductor may be coupled to a ground antenna feed terminal on an antenna ground for the corresponding antenna 30.

Radio-frequency transmission line paths 32 may include stripline transmission lines (sometimes referred to herein simply as striplines), coaxial cables, coaxial probes realized by metalized vias, microstrip transmission lines, edge-coupled microstrip transmission lines, edge-coupled stripline transmission lines, waveguide structures, conductive vias, combinations of these, etc. Multiple types of transmission lines may be used to couple the millimeter/centimeter wave transceiver circuitry to phased antenna array 36. Filter circuitry, switching circuitry, impedance matching circuitry, phase shifter circuitry, amplifier circuitry, and/or other circuitry may be interposed on radio-frequency transmission line path 32, if desired.

Radio-frequency transmission lines in device 10 may be integrated into ceramic substrates, rigid printed circuit boards, and/or flexible printed circuits. In one suitable arrangement, radio-frequency transmission lines in device 10 may be integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

Antennas 30 in phased antenna array 36 may be arranged in any desired number of rows and columns or in any other desired pattern (e.g., the antennas need not be arranged in a grid pattern having rows and columns). During signal transmission operations, radio-frequency transmission line paths 32 may be used to supply signals (e.g., radio-frequency signals such as millimeter wave and/or centimeter wave signals) from millimeter/centimeter wave transceiver circuitry 28 (FIG. 3) to phased antenna array 36 for wireless transmission. During signal reception operations, radio-frequency transmission line paths 32 may be used to convey signals received at phased antenna array 36 (e.g., from external wireless equipment 10' of FIG. 3) to millimeter/centimeter wave transceiver circuitry 28 (FIG. 3).

The use of multiple antennas 30 in phased antenna array 36 allows radio-frequency beam forming arrangements (sometimes referred to herein as radio-frequency beam steering arrangements) to be implemented by controlling the relative phases and magnitudes (amplitudes) of the radio-frequency signals conveyed by the antennas. In the example of FIG. 4, the antennas 30 in phased antenna array 36 each have a corresponding radio-frequency phase and magnitude controller 33 (e.g., a rust phase and magnitude controller 33-1 interposed on radio-frequency transmission line path 32-1 may control phase and magnitude for radio-frequency signals handled by antenna 30-1, a second phase and magnitude controller 33-2 interposed on radio-frequency transmission line path 32-2 may control phase and magnitude for radio-frequency signals handled by antenna 30-2, an Mth phase and magnitude controller 33-M interposed on radio-frequency transmission line path 32-M may control phase and magnitude for radio-frequency signals handled by antenna 30-M, etc.).

Phase and magnitude controllers 33 may each include circuitry for adjusting the phase of the radio-frequency signals on radio-frequency transmission line paths 32 (e.g., phase shifter circuits) and/or circuitry for adjusting the magnitude of the radio-frequency signals on radio-frequency transmission line paths 32 (e.g., power amplifier and/or low noise amplifier circuits). Phase and magnitude controllers 33 may sometimes be referred to collectively herein as beam steering or beam forming circuitry (e.g., beam steering circuitry that steers the beam of radio-frequency signals transmitted and/or received by phased antenna array 36).

Phase and magnitude controllers 33 may adjust the relative phases and/or magnitudes of the transmitted signals that are provided to each of the antennas in phased antenna array 36 and may adjust the relative phases and/or magnitudes of the received signals that are received by phased antenna array 36. Phase and magnitude controllers 33 may, if desired, include phase detection circuitry for detecting the phases of the received signals that are received by phased antenna array 36. The term "beam," "signal beam," "radio-frequency beam," or "radio-frequency signal beam" may be used herein to collectively refer to wireless signals that are transmitted and received by phased antenna array 36 in a particular direction. The signal beam may exhibit a peak gain that is oriented in a particular beam pointing direction at a corresponding beam pointing angle (e.g., based on constructive and destructive interference from the combination of signals from each antenna in the phased antenna array). The term "transmit beam" may sometimes be used herein to refer to radio-frequency signals that are transmitted in a particular direction whereas the term "receive beam" may sometimes be used herein to refer to radio-frequency signals that are received from a particular direction.

If, for example, phase and magnitude controllers 33 are adjusted to produce a first set of phases and/or magnitudes for transmitted radio-frequency signals, the transmitted signals will form a transmit beam as shown by beam B1 of FIG. 4 that is oriented in the direction of point A. If, however, phase and magnitude controllers 33 are adjusted to produce a second set of phases and/or magnitudes for the transmitted signals, the transmitted signals will form a transmit beam as shown by beam B2 that is oriented in the direction of point B. Similarly, if phase and magnitude controllers 33 are adjusted to produce the first set of phases and/or magnitudes, radio-frequency signals (e.g., radio-frequency signals in a receive beam) may be received from the direction of point A, as shown by beam B1. If phase and magnitude controllers 33 are adjusted to produce the second set of phases and/or magnitudes, radio-frequency signals may be received from the direction of point B, as shown by beam B2.

Each phase and magnitude controller 33 may be controlled to produce a desired phase and/or magnitude based on a corresponding control signal S received from control circuitry 38 of FIG. 4 over control paths 34 (e.g., the phase and/or magnitude provided by phase and magnitude controller 33-1 may be controlled using control signal S1 on control path 34-1, the phase and/or magnitude provided by phase and magnitude controller 33-2 may be controlled using control signal S2 on control path 34-2, the phase and/or magnitude provided by phase and magnitude controller 33-M may be controlled using control signal SM on control path 34-M, etc.). If desired, control circuitry 38 may actively adjust control signals S in real time to steer the transmit or receive beam in different desired directions (e.g., to different desired beam pointing angles) over time. Phase and magnitude controllers 33 may provide information identifying the phase of received signals to control circuitry 38 if desired.

When performing wireless communications using radio-frequency signals at millimeter and centimeter wave frequencies, the radio-frequency signals are conveyed over a line of sight path between phased antenna array 36 and external wireless equipment (e.g., external wireless equipment 10' of FIG. 3). If the external wireless equipment is located at point A of FIG. 4, phase and magnitude controllers 33 may be adjusted to steer the signal beam towards point A (e.g., to form a signal beam having a beam pointing angle directed towards point A). Phased antenna array 36 may then transmit and receive radio-frequency signals in the direction of point A. Similarly, if the external wireless equipment is located at point B, phase and magnitude controllers 33 may be adjusted to steer the signal beam towards point B (e.g., to form a signal beam having a beam pointing angle directed towards point B). Phased antenna array 36 may then transmit and receive radio-frequency signals in the direction of point B. In the example of FIG. 4, beam steering is shown as being performed over a single degree of freedom for the sake of simplicity (e.g., towards the left and right on the page of FIG. 4). However, in practice, the beam may be steered over two or more degrees of freedom (e.g., in three dimensions, into and out of the page and to the left and right on the page of FIG. 4). Phased antenna array 36 may have a corresponding field of view over which beam steering can be performed (e.g., in a hemisphere or a segment of a hemisphere over the phased antenna array). If desired, device 10 may include multiple phased antenna arrays that each face a different direction to provide coverage from multiple sides of the device.

Control circuitry 38 of FIG. 4 may form a part of control circuitry 14 of FIG. 3 or may be separate from control circuitry 14 of FIG. 3. Control circuitry 38 of FIG. 4 may identify a desired beam pointing angle for the signal beam of phased antenna array 36 and may adjust the control signals S provided to phased antenna array 36 to configure phased antenna array 36 to form (steer) the signal beam at that beam pointing angle. Each possible beam pointing angle that can be used by phased antenna array 36 during wireless communications may be identified by a beam steering codebook such as codebook 40. Codebook 40 may be stored at control circuitry 38, elsewhere on device 10, or may be located (offloaded) on external equipment and conveyed to device 10 over a wired or wireless communications link.

Codebook 40 may identify each possible beam pointing angle that may be used by phased antenna array 36. Control circuitry 38 may store or identify phase and magnitude settings for phase and magnitude controllers 33 to use in implementing each of those beam pointing angles (e.g., control circuitry 38 or codebook 40 may include information that maps each beam pointing angle for phased antenna array 36 to a corresponding set of phase and magnitude values for phase and magnitude controllers 33). Codebook 40 may be hard-coded or soft-coded into control circuitry 38 or elsewhere in device 10, may include one or more databases stored at control circuitry 38 or elsewhere in device 10 (e.g., codebook 40 may be stored as software code), may include one or more look-up-tables at control circuitry 38 or elsewhere in device 10, and/or may include any other desired data structures stored in hardware and/or software on device 10. Codebook 40 may be generated during calibration of device 10 (e.g., during design, manufacturing, and/or testing of device 10 prior to device 10 being received by an end user) and/or may be dynamically updated over time (e.g., after device 10 has been used by an end user).

Control circuitry 38 may generate control signals S based on codebook 40. For example, control circuitry 38 may identify a beam pointing angle that would be needed to communicate with external wireless equipment 10' of FIG. 3 (e.g., a beam pointing angle pointing towards external wireless equipment 10'). Control circuitry 38 may subsequently identify the beam pointing angle in codebook 40 that is closest to this identified beam pointing angle. Control circuitry 38 may use codebook 40 to generate phase and magnitude values for phase and magnitude controllers 33. Control circuitry 38 may transmit control signals S identifying these phase and magnitude values to phase and magnitude controllers 33 over control paths 34. The beam formed by phased antenna array 36 using control signals S will be oriented at the beam pointing angle identified by codebook 40. If desired, control circuitry 38 may sweep over some or all of the different beam pointing angles identified by codebook 40 until the external wireless equipment is found and may use the corresponding beam pointing angle at which the external wireless equipment was found to communicate with the external wireless equipment (e.g., over communications link 31 of FIG. 3).

Figure 5:
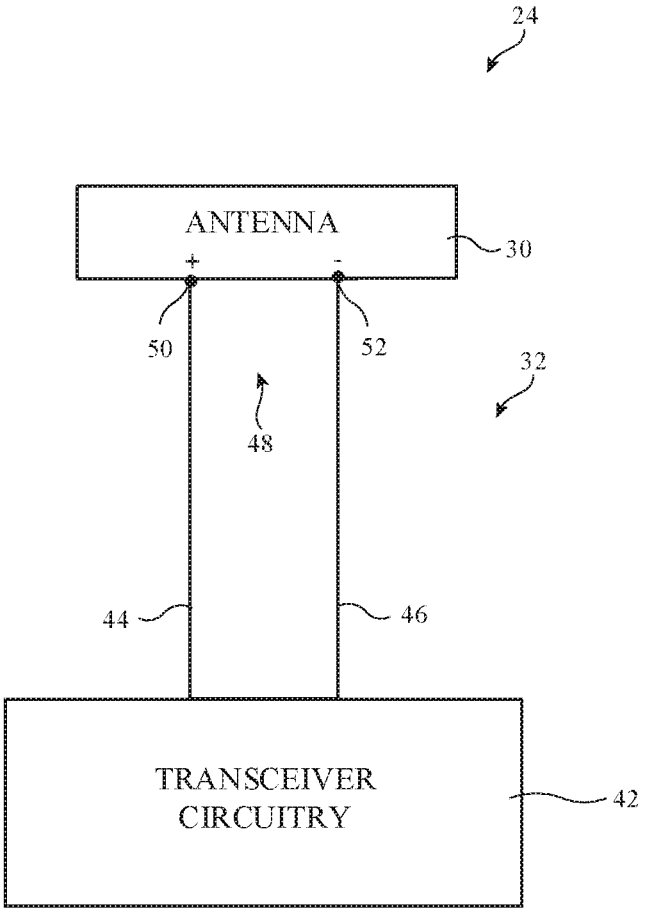
FIG. 5 is a diagram of illustrative wireless circuitry in accordance with some embodiments.

A schematic diagram of an antenna 30 that may be formed in phased antenna array 36 (e.g., as antenna 30-1, 30-2, 30-3, and/or 30-N in phased antenna array 36 of FIG. 4) is shown in FIG. 5. As shown in FIG. 5, antenna 30 may be coupled to transceiver circuitry 42 (e.g., millimeter wave transceiver circuitry 28 of FIG. 3). Transceiver circuitry 42 may be coupled to antenna feed 48 of antenna 30 using radio-frequency transmission line path 32. Antenna feed 48 may include a positive antenna feed terminal such as positive antenna feed terminal 50 and may include a ground antenna feed terminal such as ground antenna feed terminal 52. Radio-frequency transmission line path 32 may include a positive signal conductor such as signal conductor 44 that is coupled to positive antenna feed terminal 50 and a ground conductor such as ground conductor 46 that is coupled to ground antenna feed terminal 52.

Figure 6:
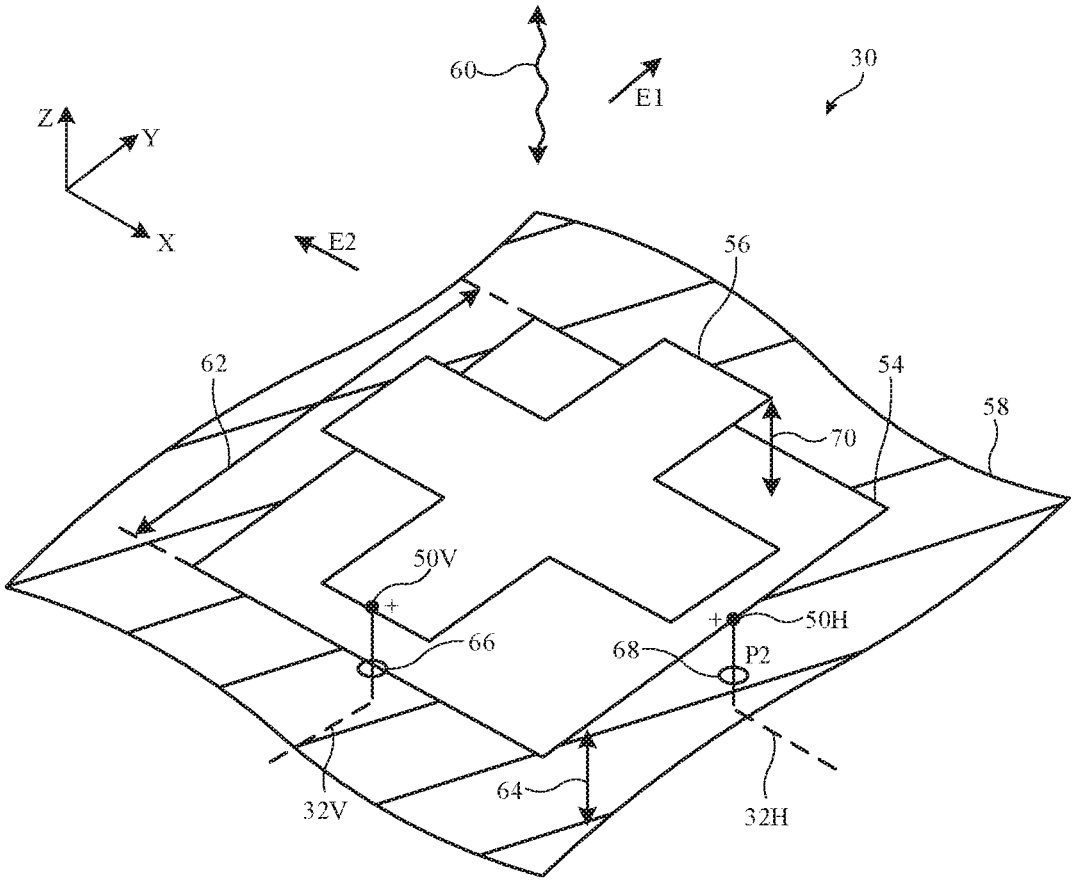
FIG. 6 is a perspective view of an illustrative antenna having stacked patch elements in accordance with some embodiments.

Any desired antenna structures may be used to form antenna 30. In one suitable arrangement that is sometimes described herein as an example, stacked patch antenna structures may be used to form antenna 30. Antennas 30 that are formed using stacked patch antenna structures may sometimes be referred to herein as stacked patch antennas or simply as patch antennas. FIG. 6 is a perspective view of an illustrative patch antenna that may be used in phased antenna array 36.

As shown in FIG. 6, antenna 30 may have a patch antenna resonating element 54 that is separated from and parallel to an antenna ground plane such as ground plane 58 (sometimes referred to herein as antenna ground 58). Patch antenna resonating element 54 may lie within a plane such as the X-Y plane of FIG. 6 (e.g., the lateral surface area of element 54 may lie in the X-Y plane). Patch antenna resonating element 54 may sometimes be referred to herein as patch 54, patch element 54, patch resonating element 54, antenna resonating element 54, or resonating element 54. Ground plane 58 may lie within a plane that is parallel to the plane of patch element 54. Patch element 54 and ground plane 58 may therefore lie in separate parallel planes that are separated by a distance 64. Patch element 54 and ground plane 58 may be formed from conductive traces patterned on a dielectric substrate.

The length of the sides of patch element 54 may be selected so that antenna 30 resonates at a desired operating frequency. For example, the sides of patch element 54 may each have a length 62 that is approximately equal to half of the wavelength of the signals conveyed by antenna 30 (e.g., the effective wavelength given the dielectric properties of the materials surrounding patch element 54). In one suitable arrangement, length 62 may be between 0.8 mm and 1.2 mm (e.g., approximately 1.1 mm) for covering a millimeter wave frequency band between 57 GHz and 70 GHz or between 1.6 mm and 2.2 mm (e.g., approximately 1.85 mm) for covering a millimeter wave frequency band between 37 GHz and 41 GHz, as just two examples.

The example of FIG. 6 is merely illustrative. Patch element 54 may have a square shape in which all of the sides of patch element 54 are the same length or may have a different rectangular shape. Patch element 54 may be formed in other shapes having any desired number of straight and/or curved edges. If desired, patch element 54 and ground plane 58 may have different shapes and relative orientations.

To enhance the polarizations handled by antenna 30, antenna 30 may be provided with multiple antenna feeds. As shown in FIG. 6, antenna 30 may have a first antenna feed at antenna port P1 that is coupled to a first radio-frequency transmission line path 32 (FIG. 5) such as transmission line path 32V. Antenna 30 may also have a second feed at antenna port P2 that is coupled to a second radio-frequency transmission line path 32 such as transmission line path 32H. The first antenna feed may have a first ground feed terminal coupled to ground plane 58 (not shown in FIG. 6 for the sake of clarity) and a first positive antenna feed terminal 50V coupled to patch element 54. The second antenna feed may have a second ground feed terminal coupled to ground plane 58 (not shown in FIG. 6 for the sake of clarity) and a second positive antenna feed terminal 50H on patch element 54.

Holes or openings such as openings 66 and 68 may be formed in ground plane 58. Transmission line path 32V may include a vertical conductor (e.g., a conductive through-via, conductive pin, metal pillar, solder bump, combinations of these, or other vertical conductive interconnect structures) that extends through opening 66 to positive antenna feed terminal 50V on patch element 54. Transmission line path 32H may include a vertical conductor that extends through opening 68 to positive antenna feed terminal 50H on patch element 54. This example is merely illustrative and, if desired, other transmission line structures may be used (e.g., coaxial cable structures, stripline transmission line structures, etc.).

When using the first antenna feed associated with port P1, antenna 30 may transmit and/or receive radio-frequency signals having a first polarization (e.g., the electric field E1 of antenna signals 60 associated with port P1 may be oriented parallel to the Y-axis in FIG. 6). When using the antenna feed associated with port P2, antenna 30 may transmit and/or receive radio-frequency signals having a second polarization (e.g., the electric field E2 of antenna signals 60 associated with port P2 may be oriented parallel to the X-axis of FIG. 6 so that the polarizations associated with ports P1 and P2 are orthogonal to each other).

One of ports P1 and P2 may be used at a given time so that antenna 30 operates as a single-polarization antenna or both ports may be operated at the same time so that antenna 30 operates with other polarizations (e.g., as a dual-polarization antenna, a circularly-polarized antenna, an elliptically-polarized antenna, etc.). If desired, the active port may be changed over time so that antenna 30 can switch between covering vertical or horizontal polarizations at a given time. Ports P1 and P2 may be coupled to different phase and magnitude controllers 33 (FIG. 4) or may both be coupled to the same phase and magnitude controller 33. If desired, ports P1 and P2 may both be operated with the same phase and magnitude at a given time (e.g., when antenna 30 acts as a dual-polarization antenna). If desired, the phases and magnitudes of radio-frequency signals conveyed over ports P1 and P2 may be controlled separately and varied over time so that antenna 30 exhibits other polarizations (e.g., circular or elliptical polarizations).

If care is not taken, antennas 30 such as dual-polarization patch antennas of the type shown in FIG. 6 may have insufficient bandwidth for covering an entirety of a frequency band of interest (e.g., a frequency band at frequencies greater than 10 GHz). For example, in scenarios where antenna 30 is configured to cover a millimeter wave communications band between 57 GHz and 71 GHz, patch element 54 as shown in FIG. 6 may have insufficient bandwidth to cover the entirety of the frequency range between 57 GHz and 71 GHz. If desired, antenna 30 may include one or more parasitic antenna resonating elements that serve to broaden the bandwidth of antenna 30.

As shown in FIG. 6, a bandwidth-widening parasitic antenna resonating element such as parasitic antenna resonating element 56 may be formed from conductive structures located at a distance 70 over patch element 54. Parasitic antenna resonating element 56 may sometimes be referred to herein as parasitic resonating element 56, parasitic antenna element 56, parasitic element 56, parasitic patch 56, parasitic conductor 56, parasitic structure 56, parasitic 56, or patch 56. Parasitic element 56 is not directly fed, whereas patch element 54 is directly fed via transmission line paths 32V and 32H and positive antenna feed terminals 50V and 50H.

Parasitic element 56 may create a constructive perturbation of the electromagnetic field generated by patch element 54, creating a new resonance for antenna 30. This may serve to broaden the overall bandwidth of antenna 30 (e.g., to cover an entire frequency band from 24 GHz to 31 GHz).

At least some or an entirety of parasitic element 56 may overlap patch element 54. In the example of FIG. 6, parasitic element 56 has a cross or "X" shape. In order to form the cross shape, parasitic element 56 may include notches or slots formed by removing conductive material from the corners of a square or rectangular metal patch. Parasitic element 56 may have a rectangular (e.g., square) outline or footprint. Removing conductive material from parasitic element 56 to form a cross shape may serve to adjust the impedance of patch element 54 so that the impedance of patch element 54 is matched to both transmission line paths 32V and 32H, for example. The example of FIG. 6 is merely illustrative. If desired, parasitic element 56 may have other shapes or orientations.

If desired, antenna 30 of FIG. 6 may be formed on a dielectric substrate (not shown in FIG. 6 for the sake of clarity). The dielectric substrate may be, for example, a rigid or printed circuit board or other dielectric substrate. The dielectric substrate may include multiple stacked dielectric layers (e.g., multiple layers of printed circuit board substrate such as multiple layers of fiberglass-filled epoxy, multiple layers of ceramic substrate, etc.). Ground plane 58, patch element 54, and parasitic element 56 may be formed from conductive traces on different layers of the dielectric substrate.

When configured in this way, antenna 30 may cover a relatively wide frequency band of interest such as a frequency band between 24 GHz and 31 GHz. The example of FIG. 6 is merely illustrative. Parasitic element 56 may be omitted if desired. Antenna 30 may have any desired number of feeds. Other feeding arrangements may be used. Antenna 30 may include any desired type of antenna resonating element structures. If desired, antenna 30 may include multiple vertically-stacked patch elements 54.

Figure 7:
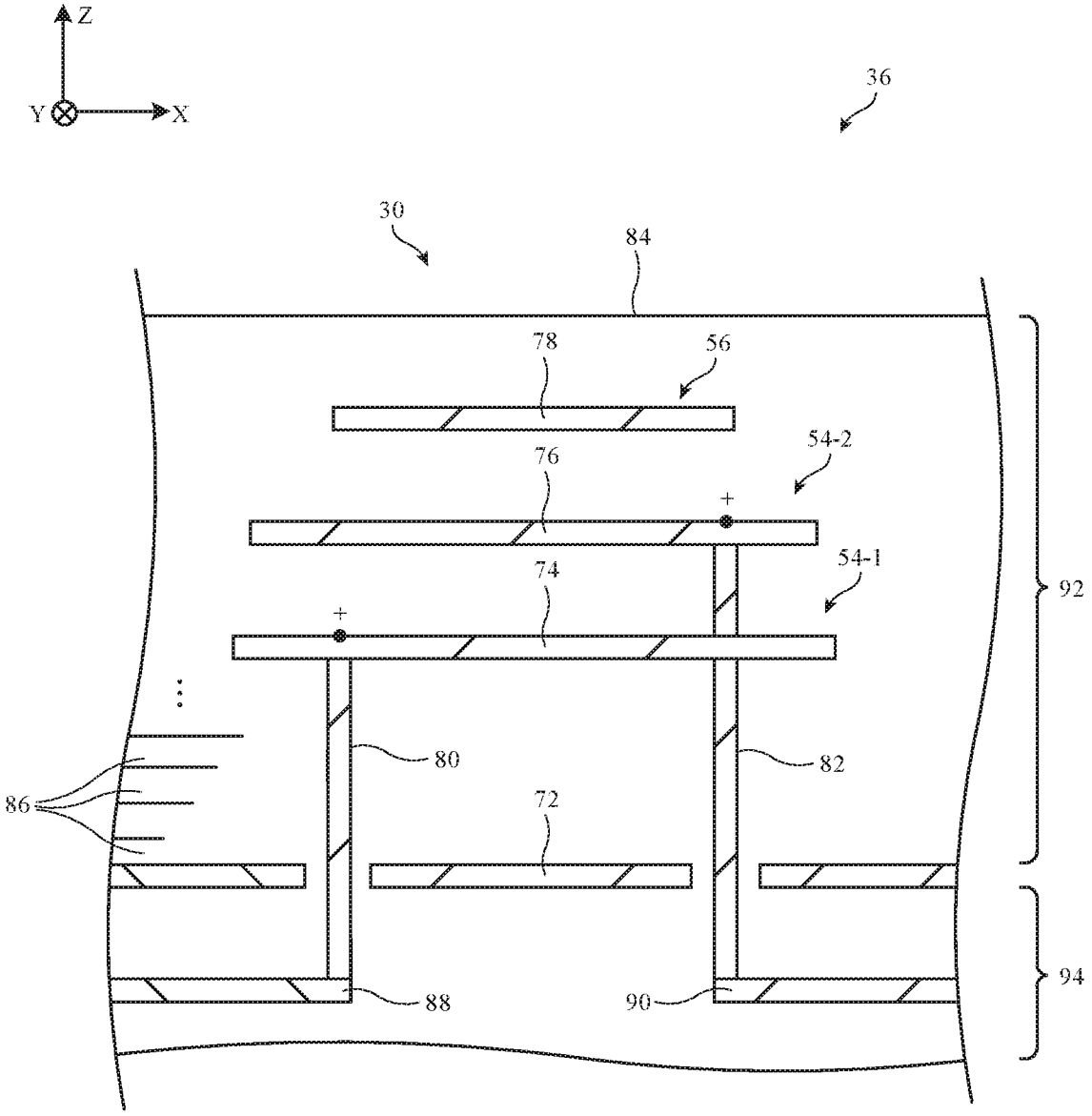
FIG. 7 is a cross-sectional side view of an illustrative antenna having three layers of stacked patch elements in accordance with some embodiments.

FIG. 7 is a cross-sectional side view showing how antenna 30 may include two vertically-stacked patch elements 54. As shown in FIG. 7, antenna 30 may include multiple patch elements 54 such as a first patch element 54-1 and a second patch element 54-2. Patch element 54-2 may be vertically stacked over patch element 54-1. Patch element 54-2 may completely or partially overlap patch element 54-1. Patch element 54-2 may have different dimensions than patch element 54-1 (e.g., for creating additional resonances to cover additional frequencies) or may have similar (e.g., identical) dimensions to patch element 54-1. Parasitic element 56 may be vertically stacked over patch element 54-2 and may overlap both patch elements 54-1 and 54-2.

Antenna 30 may be formed on a dielectric substrate such as substrate 84. If desired, each of the antennas in the phased antenna array may be formed on the same dielectric substrate (e.g., in an integrated antenna module having a radio-frequency integrated circuit mounted to substrate 84). Substrate 84 may be, for example, a rigid or printed circuit board or another dielectric substrate. Substrate 84 may include multiple stacked dielectric layers 86 (e.g., layers of printed circuit board substrate, layers of fiberglass-filled epoxy, layers of polyimide, layers of ceramic substrate, or layers of other dielectric materials).

With this type of arrangement, antenna 30 may be embedded within the layers of substrate 84. For example, antenna 30 may have an antenna ground (e.g., a ground plane for antenna 30 such as ground plane 58 of FIG. 6) that includes ground traces 72. The same ground traces 72 may be used to form the antenna ground for each antenna in the phased antenna array if desired. Ground traces 72 may be patterned onto a first layer 86 of substrate 84.

Patch element 54-1 may be formed from a first layer of conductive traces 74 patterned onto a second layer 86 of substrate 84. Patch element 54-2 may be formed from a second layer of conductive traces 76 patterned onto a third layer 86 of substrate 84. Parasitic element 56 may be formed from a third layer of conductive traces 78 patterned onto a fourth layer 86 of substrate 84 (e.g., where the second layer is interposed between the first and third layers and the third layer is interposed between the second and fourth layers).

One or more layers 86 of substrate 84 may be vertically interposed between ground traces 72 and the first layer of conductive traces 74. One or more layers 86 of substrate 84 may be vertically interposed between the first layer of conductive traces 74 and the second layer of conductive traces 76. One or more layers 86 of substrate 84 may be vertically interposed between the second layer of conductive traces 76 and the third layer of conductive traces 78. Zero, one, or more than one layer 86 in substrate 84 may be vertically interposed between the third layer of conductive traces 78 and the exterior of substrate 84.

Signal traces 88 and 90 may be patterned onto one or more of the layers 86 in substrate 84 (e.g., ground traces 72 may be vertically interposed between signal traces 88/90 and patch element 54-1). Signal traces 88 may, for example, form the signal conductor of a radio-frequency transmission line path for patch element 54-1 (e.g., signal conductor 44 in radio-frequency transmission line path 32 of FIG. 5). A conductive via such as conductive via 80 may couple signal traces 88 to patch element 54-1 (e.g., at a positive antenna feed terminal for patch element 54-1 such as positive antenna feed terminals 50V or 50H of FIG. 6). Similarly, signal traces 90 may form the signal conductor of a radio-frequency transmission line path for patch element 54-2. A conductive via such as conductive via 82 may couple signal traces 90 to patch element 54-2 (e.g., at a positive antenna feed terminal for patch element 54-2 such as positive antenna feed terminals 50V or 50H of FIG. 6).

The example of FIG. 7 shows only a single positive antenna feed terminal on patch element 54-1 and only a single positive antenna feed terminal on patch element 54-2 for the sake of clarity. If desired, patch element 54-1 and/or patch element 54-2 may have two positive antenna feed terminals (e.g., positive antenna feed terminals 50H and 50V of FIG. 6) for covering multiple polarizations.

The layers 86 in substrate 84 that include patch elements 54 and parasitic element 56 may sometimes be referred to collectively herein as antenna layers 92. The layers 86 in substrate 84 that include signal traces 88 and 90 may sometimes be referred to herein as routing layers 94, transmission line routing layers 94, or transmission line layers 94. Ground traces 72 may separate routing layers 94 from antenna layers 92.

The example of FIG. 7 is merely illustrative. In general, antenna 30 may include any desired number of layers of conductive traces that are vertically stacked over ground traces 72 (e.g., three layers of conductive traces 74, 76, and 78 as shown in FIG. 7, only two layers of conductive traces, four or more layers of conductive traces, etc.). Each layer of conductive traces may be used to form a corresponding patch element 54 and/or one or more parasitic elements 56 in antenna 30. For example, the second layer of conductive traces 76 may form an additional parasitic element 56. In another example, the third layer of conductive traces 78 may form a third patch element 54 for antenna 30 (e.g., a patch element that is directly fed using one or two positive antenna feed terminals coupled to the patch element).

If desired, additional layers of conductive traces may be stacked over the third layer of conductive traces 78 and may form additional patch elements 54 and/or parasitic elements 56 for antenna 30. Antenna 30 need not be fed using conductive vias such as conductive vias 80 and 82. If desired, antenna 30 may be capacitively fed or slot-fed. Portions of the first and second layers of conductive traces 74 and 76 may be used to form one or more parasitic elements 56 (e.g., in addition to forming patch elements 54-1 and 54-2). The layers of conductive traces in antenna layers 92 need not be used to form patch antenna resonating elements and may, in general, be used to form antenna resonating elements of any type for antenna 30. The layers of conductive traces in antenna layers 92 (e.g., the first layer of conductive traces 74, the second layer of conductive traces 76, and the third layer of conductive traces 78) may sometimes be referred to herein as layers of antenna traces or simply as conductive antenna layers.

Figure 8:
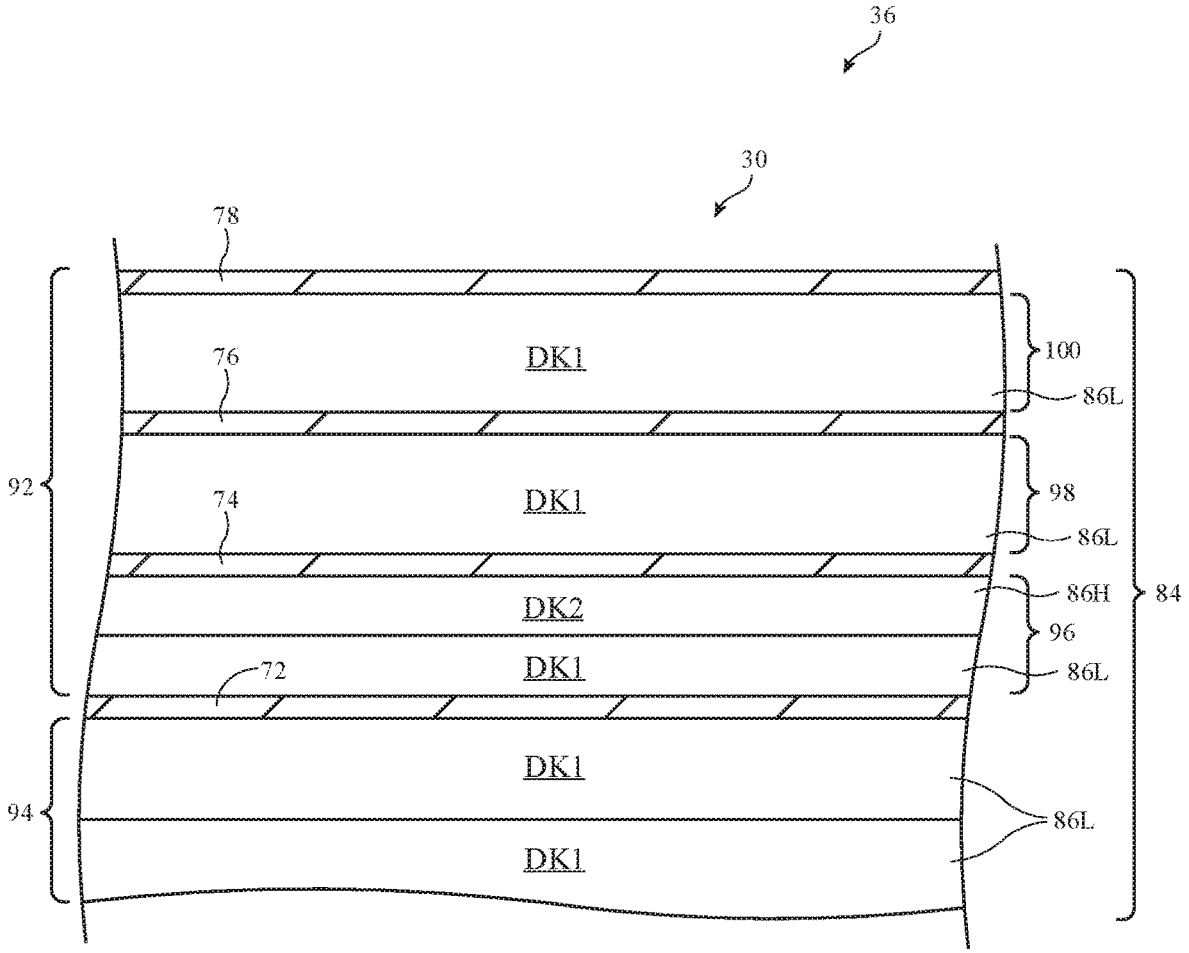
FIG. 8 is a cross-sectional side view showing how an illustrative antenna having stacked patch elements may be differentially loaded by a dielectric substrate in accordance with some embodiments.

In some scenarios, the same material is used to form each of the antenna layers 92 and each of the routing layers 92 in substrate 84. In these scenarios, the bandwidth of the antenna is controlled by adjusting the feed location/method and/or the dimensions of the patch elements and parasitic elements. In one suitable arrangement that is described herein as an example, in order to further expand the bandwidth of antenna 30, antenna 30 may be differentially loaded by providing dielectric layers having different dielectric permittivities across antenna layers 92. FIG. 8 is a cross-sectional side view showing how antenna 30 may be differentially loaded.

As shown in FIG. 8, the layers 86 in substrate 84 may include one or more relatively low dielectric permittivity layers 86L (sometimes referred to herein as low dielectric permittivity layers 86L or low permittivity layers 86L) and one or more relatively high dielectric permittivity layers 86H (sometimes referred to herein as high dielectric permittivity layers 86H or high permittivity layers 86H). High dielectric permittivity layers 86H may have relatively high dielectric permittivity DK2. Relatively high dielectric permittivity DK2 may be defined by the particular material used to form the high dielectric permittivity layer. Relatively high dielectric permittivity DK2 may be, for example, between 6.0 and 8.0, between 6.5 and 7.5, between 5.0 and 9.0, greater than 4.5, greater than 9.0, greater than 10.0, or any other desired permittivity greater than 4.0. As an example, high dielectric permittivity layers 86H may be formed using low-temperature co-fired ceramics (LTCC) or other ceramics/dielectrics having dielectric permittivity DK2.

Low dielectric permittivity layers 86L may have relatively low dielectric permittivity DK1. Relatively low dielectric permittivity DK1 is less than relatively high dielectric permittivity DK2 and may be, for example, between 3.0 and 4.0, between 2.0 and 5.0, between 3.3 and 3.7, less than 4.0, less than 4.5, or any other desired permittivity less than relatively high dielectric permittivity DK2. As an example, low dielectric permittivity layers 86L may be formed using low-temperature co-fired ceramics (LTCC) or other ceramics/dielectrics having dielectric permittivity DK1.

As shown in FIG. 8, routing layers 94 may include two or more low dielectric permittivity layers 86L. Forming routing layers 94 using low dielectric permittivity layers 86L may, for example, minimize transmission line losses for antenna 30. Ground traces 72 may be patterned onto the upper-most routing layer 94.

Antenna layers 92 may include a first set of antenna layers 96, a second set of antenna layers 98, and a third set of antenna layers 100. The first set of antenna layers 96 may be vertically interposed between ground traces 72 and the first layer of conductive traces 74. The second set of antenna layers 98 may be vertically interposed between the first layer of conductive traces 74 and the second layer of conductive traces 76. The third set of antenna layers 100 may be vertically interposed between the second layer of conductive traces 76 and the third layer of conductive traces 78.

The first set of antenna layers 96 may include one, two, or more than two layers 86. The first layer of conductive traces 74 in antenna 30 may be patterned onto the uppermost layer 86 in the first set of antenna layers 96. The second set of antenna layers 98 may include one, two, or more than two layers 86. The second layer of conductive traces 76 in antenna 30 may be patterned onto the uppermost layer 86 in the second set of antenna layers 98. The third set of antenna layers 100 may include one, two, or more than two layers 86. The third layer of conductive traces 78 in antenna 30 may be patterned onto the uppermost layer 86 in the third set of antenna layers 100.

The first layer of conductive traces 74 may be used to form a patch element 54 (e.g., patch element 54-1 of FIG. 7) and/or one or more parasitic elements 56 for antenna 30. The second layer of conductive traces 76 may be used to form a patch element 54 (e.g., patch element 54-2 of FIG. 7) and/or one or more parasitic elements 56 for antenna 30. The third layer of conductive traces 78 may be used to form a patch element 54 and/or one or more parasitic elements 56 for antenna 30 (e.g., the third layer of conductive traces 78 may include only parasitic elements 56 in the arrangement of FIG. 7).

The first set of antenna layers 96 may have a first bulk (effective) dielectric permittivity. The first bulk dielectric permittivity may be determined by the combination (e.g., average) of the dielectric permittivities of each of the layers 86 in the first set of antenna layers 96. The second set of antenna layers 98 may have a second bulk (effective) dielectric permittivity. The second bulk dielectric permittivity may be determined by the combination (e.g., average) of the dielectric permittivities of each of the layers 86 in the second set of antenna layers 98. The third set of antenna layers 100 may have a third bulk (effective) dielectric permittivity. The third bulk dielectric permittivity may be determined by the combination (e.g., average) of the dielectric permittivities of each of the layers 86 in the third set of antenna layers 100.

Antenna 30 may be differentially loaded by configuring antenna layers 92 such that the first, second, and third bulk dielectric permittivities are not all equal to each other. In one suitable arrangement, the second bulk dielectric permittivity of the second set of antenna layers 98 is equal to the third bulk dielectric permittivity of the third set of antenna layers 100 and the first bulk dielectric permittivity of the first set of antenna layers 96 is different from the second and third bulk dielectric permittivities. In another suitable arrangement, the first bulk dielectric permittivity of the first set of antenna layers 96 is equal to the third bulk dielectric permittivity of the third set of antenna layers 100 and the second bulk dielectric permittivity of the second set of antenna layers 98 is different from the first and third bulk dielectric permittivities. In another suitable arrangement, the first bulk dielectric permittivity of the first set of antenna layers 96 is equal to the second bulk dielectric permittivity of the second set of antenna layers 98 and the third bulk dielectric permittivity of the third set of antenna layers 100 is different from the first and second bulk dielectric permittivities. In yet another suitable arrangement, the first, second, and third bulk dielectric permittivities are all different from each other.

The first bulk dielectric permittivity of the first set of antenna layers 96 may be determined by the ratio of the number of high dielectric permittivity layers 86H to the number of low dielectric permittivity layers 86L in the first set of antenna layers 96. Similarly, the second bulk dielectric permittivity of the second set of antenna layers 98 may be determined by the ratio of the number of high dielectric permittivity layers 86H to the number of low dielectric permittivity layers 86L in the second set of antenna layers 98. In addition, the third bulk dielectric permittivity of the third set of antenna layers 100 may be determined by the ratio of high dielectric permittivity layers 86H to low dielectric permittivity layers 86L in the third set of antenna layers 100.

For example, as shown in FIG. 8, the first set of antenna layers 96 may include a low dielectric permittivity layer 86L and a high dielectric permittivity layer 86H (e.g., there may be one low dielectric permittivity layer 86L for every high dielectric permittivity layer 86H in the first set of antenna layers 96), whereas the second set of antenna layers 98 and the third set of antenna layers 100 each only include a single low dielectric permittivity layers 86L. This may configure the first set of antenna layers 96 to exhibit a greater bulk dielectric permittivity than the second set of antenna layers 98 and the third set of antenna layers 100.

The example of FIG. 8 is merely illustrative. If desired, the second set of antenna layers 98 and/or the third set of antenna layers 100 may include more than one low dielectric permittivity layer 86L. Similarly, the first set of antenna layers 96 may include more than one low dielectric permittivity layer 86L and/or more than one high dielectric permittivity layer 86H. In another suitable arrangement, the first set of antenna layers 96 and the third set of antenna layers 100 may each include only low dielectric permittivity layers 86L (e.g., one or more low dielectric permittivity layers 86L)

whereas the second set of antenna layers 98 includes both low dielectric permittivity layers 86L (e.g., one or more low dielectric permittivity layers 86L) and high dielectric permittivity layers 86H (e.g., one or more high dielectric permittivity layers 86H). In yet another suitable arrangement, the first set of antenna layers 96 and the second set of antenna layers 98 may each include only low dielectric permittivity layers 86L (e.g., one or more low dielectric permittivity layers 86L) whereas the third set of antenna layers 100 includes both low dielectric permittivity layers 86L (e.g., one or more low dielectric permittivity layers 86L) and high dielectric permittivity layers 86H (e.g., one or more high dielectric permittivity layers 86H). In yet another suitable arrangement, both the first set of antenna layers 96 and the second set of antenna layers 98 may each include one or more low dielectric permittivity layers 86L and one or more high dielectric permittivity layers 86H whereas the third set of antenna layers 100 includes only low dielectric permittivity layers 86L (e.g., one or more low dielectric permittivity layers 86L). In yet another suitable arrangement, both the first set of antenna layers 96 and the third set of antenna layers 100 may each include one or more low dielectric permittivity layers 86L and one or more high dielectric permittivity layers 86H whereas the second set of antenna layers 98 includes only low dielectric permittivity layers 86L (e.g., one or more low dielectric permittivity layers 86L). In yet another suitable arrangement, both the second set of antenna layers 98 and the third set of antenna layers 100 may each include one or more low dielectric permittivity layers 86L and one or more high dielectric permittivity layers 86H whereas the first set of antenna layers 96 includes only one or more low dielectric permittivity layers 86L. In still another suitable arrangement, the first set of antenna layers 96, the second set of antenna layers 98, and the third set of antenna layers 100 may each include both low dielectric permittivity layers 86L and high dielectric permittivity layers 86H, where the ratio of the number of high dielectric permittivity layers 86H to low dielectric permittivity layers 86L varies between the first, second, and third sets of antenna layers. If desired, the low dielectric permittivity layers 86L and the high dielectric permittivity layers 86H may be swapped in each of these combinations.

In general, any desired combination of one or more low dielectric permittivity layers 86L and/or one or more high dielectric permittivity layers 86H may be included in the first set of antenna layers 96, the second set of antenna layers 98, and the third set of antenna layers 100 to provide the sets of antenna layers with any desired first, second, and third bulk dielectric permittivities, respectively (e.g., such that the bulk dielectric permittivities are not all uniform between the first set of antenna layers 96, the second set of antenna layers 98, and the third set of antenna layers 100). If desired, the third layer of conductive traces 78 and the third set of antenna layers 100 may be omitted from substrate 84 and antenna 30. In these scenarios, the bulk dielectric constant of the first set of antenna layers 96 may be different from the bulk dielectric constant of the second set of antenna layers 98. In scenarios where antenna 30 includes more than three layers of conductive traces in antenna layers 92, antenna 30 may be differentially loaded by providing different bulk dielectric permittivities between any desired combination of the layers of conductive traces. If desired, substrate 84 may include additional layers 86 having other dielectric permittivities (e.g., substrate 84 may include low dielectric permittivity layers 86L, high dielectric permittivity layers 86H, and additional layers having other dielectric permittivities such as a dielectric permittivity DK3 that is greater than dielectric permittivity DK2). The ratio of each of the layers may be varied between the sets of antenna layers to differentially load antenna 30.

Figure 9:
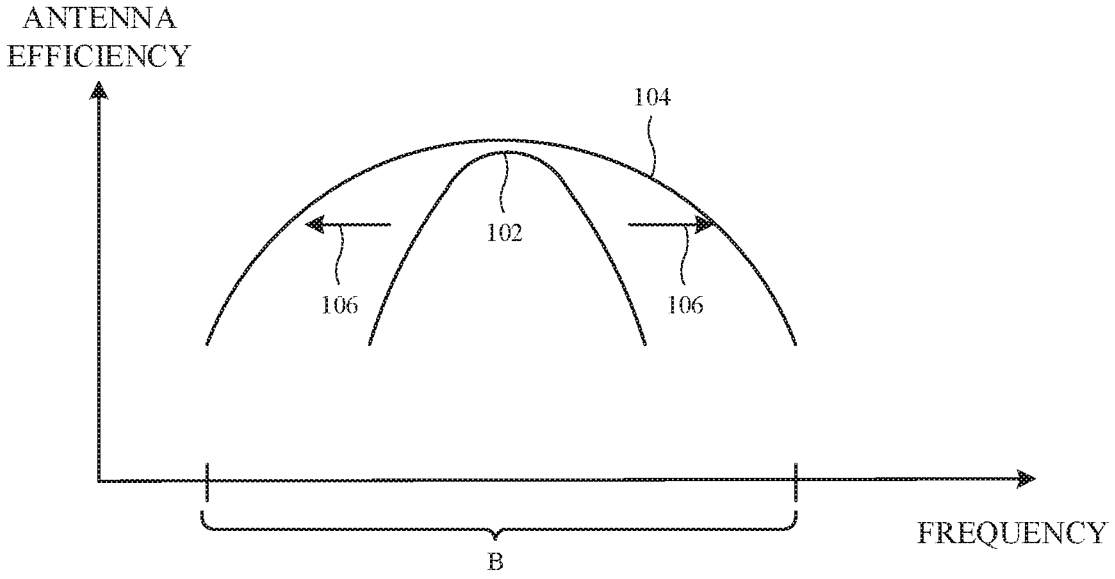
FIG. 9 is a plot of antenna performance (antenna efficiency) as a function of frequency for an illustrative antenna in accordance with some embodiments.

Differentially loading antenna 30 in this way may serve to maximize the bandwidth of antenna 30. FIG. 9 is a plot showing how differentially loading antenna 30 may maximize the bandwidth of antenna 30. As shown in FIG. 9, curve 102 plots the antenna efficiency as a function of frequency for antenna 30 in scenarios where the first set of antenna layers 96, the second set of antenna layers 98, and the third set of antenna layers 100 of FIG. 8 all have the same bulk dielectric permittivity. As shown by curve 102, when configured in this way, antenna 30 may exhibit insufficient bandwidth to cover the entirety of a frequency band of interest such as frequency band B (e.g., a frequency band from 24-31 GHz).

Curve 104 plots the antenna efficiency for antenna 30 in scenarios where antenna 30 is differentially loaded. As shown by curves 102 and 104, differentially loading antenna 30 may serve to broaden the bandwidth of antenna 30 (e.g., as shown by arrows 106), such that antenna 30 exhibits satisfactory antenna efficiency across the entirety of frequency band B. The example of FIG. 9 is merely illustrative. In practice, curves 102 and 104 may have other shapes. Antenna 30 may convey radio-frequency signals in any desired number of frequency bands at any desired frequencies (e.g., frequencies greater than 10 GHz).

Device 10 may gather and/or use personally identifiable information. It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The foregoing is merely illustrative and various modifications can be made by those skilled in the art without departing from the scope and spirit of the described embodiments. The foregoing embodiments may be implemented individually or in any combination.

What is claimed is:

1. An antenna comprising:

a dielectric substrate having routing layers, a first set of antenna layers on the routing layers, and a second set of antenna layers on the first set of antenna layers, the first set of antenna layers being interposed between the routing layers and the second set of antenna layers;

signal traces on the routing layers;

ground traces on an uppermost layer of the routing layers;

a first layer of conductive traces on an uppermost layer of the first set of antenna layers, the signal traces being coupled to a positive antenna feed terminal on the first layer of conductive traces and the first layer of conductive traces being configured to radiate at a frequency greater than 10 GHz; and a second layer of conductive traces on an uppermost layer of the second set of antenna layers, wherein the second layer of conductive traces at least partially overlaps the first layer of conductive traces, the first set of antenna layers has a first bulk dielectric permittivity, and the second set of antenna layers has a second bulk dielectric permittivity that is different from the first bulk dielectric permittivity.

2. The antenna of claim 1, wherein the first set of antenna layers comprises a first layer having a first dielectric permittivity and a second layer having a second dielectric permittivity that is greater than the first dielectric permittivity.

3. The antenna of claim 2, wherein the second bulk dielectric permittivity is equal to the first dielectric permittivity.

4. The antenna of claim 3, wherein the routing layers have a third bulk dielectric permittivity equal to the first dielectric permittivity.

5. The antenna of claim 3, wherein the dielectric substrate has a third set of antenna layers on the second set of antenna layers, the second set of antenna layers being interposed between the first and third sets of antenna layers, the antenna further comprising:

a third layer of conductive traces on an uppermost layer of the third set of antenna layers.

6. The antenna of claim 5, wherein the third set of antenna layers has a third bulk dielectric permittivity equal to the first dielectric permittivity.

7. The antenna of claim 5, wherein the third set of antenna layers has a third bulk dielectric permittivity that is different from the first and second bulk dielectric permittivities.

8. The antenna of claim 5, wherein the signal traces are coupled to an additional positive antenna feed terminal on the second layer of conductive traces.

9. The antenna of claim 8, wherein the third layer of conductive traces comprises a parasitic patch.

10. The antenna of claim 1, wherein the second set of antenna layers comprises a first layer having a first dielectric permittivity and a second layer having a second dielectric permittivity that is greater than the first dielectric permittivity, the first bulk dielectric permittivity being equal to the first dielectric permittivity.

11. The antenna of claim 1, wherein the dielectric substrate has a third set of antenna layers on the second set of antenna layers, the second set of antenna layers being interposed between the first and third sets of antenna layers, the antenna further comprising:

a third layer of conductive traces on an uppermost layer of the third set of antenna layers, wherein the third set of antenna layers has a third bulk dielectric permittivity equal to the first bulk dielectric permittivity.

12. The antenna of claim 1, wherein the dielectric substrate has a third set of antenna layers on the second set of antenna layers, the second set of antenna layers being interposed between the first and third sets of antenna layers, the antenna further comprising:

a third layer of conductive traces on an uppermost layer of the third set of antenna layers, wherein the third set of antenna layers has a third bulk dielectric permittivity equal to the second bulk dielectric permittivity.

13. An antenna comprising:

a dielectric substrate having first, second, third, and fourth layers, wherein the second layer is interposed between the first and third layers, the third layer is interposed between the second and fourth layers, the first layer has a first dielectric permittivity, one of the second, third, and fourth layers has the first dielectric permittivity, and one of the second, third, and fourth layers has a second dielectric permittivity that is greater than the first dielectric permittivity;

ground traces on the first layer;

a first patch element on the second layer and at least partially overlapping the ground traces, the first patch element being configured to radiate at a frequency greater than 10 GHz;

a second patch element on the third layer and at least partially overlapping the first patch element;

a third patch element on the fourth layer and at least partially overlapping the second patch element; and a positive antenna feed terminal on the first patch element.

14. The antenna of claim 13, further comprising:

an additional positive antenna feed terminal on the second patch element.

15. The antenna of claim 14, wherein the third patch element comprises a parasitic element.

16. The antenna of claim 15, wherein the second layer has the second dielectric permittivity, the third layer has the first dielectric permittivity, and the fourth layer has the first dielectric permittivity.

17. An antenna comprising:

a dielectric substrate having routing layers, a first set of antenna layers on the routing layers, a second set of antenna layers on the first set of antenna layers, and a third set of antenna layers on the second set of antenna layers, the first set of antenna layers being interposed between the routing layers and the second set of antenna layers, and the second set of antenna layers being interposed between the first and third sets of antenna layers;

signal traces on the routing layers;

ground traces on an uppermost layer of the routing layers;

a first layer of conductive traces on an uppermost layer of the first set of antenna layers, the signal traces being coupled to a positive antenna feed terminal on the first layer of conductive traces and the first layer of conductive traces being configured to radiate at a frequency greater than 10 GHz;

a second layer of conductive traces on an uppermost layer of the second set of antenna layers; and a third layer of conductive traces on an uppermost layer of the third set of antenna layers, wherein the first set of antenna layers has a first bulk dielectric permittivity and the third set of antenna layers has a second bulk dielectric permittivity that is different from the first bulk dielectric permittivity.

18. The antenna of claim 17, wherein the second set of antenna layers has the first bulk dielectric permittivity.

19. The antenna of claim 17, wherein the second set of antenna layers has the second bulk dielectric permittivity.

20. The antenna of claim 17, wherein the second set of antenna layers has a third bulk dielectric permittivity that is different from the first and second dielectric permittivities.

* * * * *